US008789543B2

(12) United States Patent
Hartmann et al.

(10) Patent No.: US 8,789,543 B2
(45) Date of Patent: Jul. 29, 2014

(54) DISHWASHER WITH A DISSOLVING CHAMBER

(75) Inventors: Michael Hartmann, Hoechstaedt (DE); Bernd Schessl, Dillingen/Dónau (DE); Erich Schmid, Sontheim a.d.Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 921 days.

(21) Appl. No.: 11/794,522

(22) PCT Filed: Oct. 21, 2005

(86) PCT No.: PCT/EP2005/055465

§ 371 (c)(1),
(2), (4) Date: Jun. 28, 2007

(87) PCT Pub. No.: WO2006/072483

PCT Pub. Date: Jul. 13, 2006

(65) Prior Publication Data

US 2010/0065091 A1 Mar. 18, 2010

(30) Foreign Application Priority Data

Dec. 29, 2004 (DE) ..... 10 2004 063 286

(51) Int. Cl.
*A47L 15/44* (2006.01)

(52) U.S. Cl.
USPC ..... 134/93; 134/56 D; 134/57 D

(58) Field of Classification Search
USPC ..... 134/93, 135, 200, 104.2, 56 D, 57 D
See application file for complete search history.

(56) References Cited

U.S. PATENT DOCUMENTS

| | | | | |
|---|---|---|---|---|
| 1,959,661 | A * | 5/1934 | Ellington et al. | 134/112 |
| 2,035,625 | A * | 3/1936 | Walker | 220/488 |
| 2,194,342 | A * | 3/1940 | Walker | 134/183 |
| 2,315,890 | A * | 4/1943 | Bader | 206/0.5 |
| 2,552,852 | A * | 5/1951 | Idle | 134/93 |
| 2,653,618 | A * | 9/1953 | Frank | 134/93 |

(Continued)

FOREIGN PATENT DOCUMENTS

| | | | |
|---|---|---|---|
| CA | 2 176 544 | * | 11/1997 |
| DE | 93 17 963 U | | 3/1995 |

(Continued)

OTHER PUBLICATIONS

European Patent Office 0 755 650 Jan. 1997.*

(Continued)

*Primary Examiner* — Michael Barr
*Assistant Examiner* — Benjamin L Osterhout
(74) *Attorney, Agent, or Firm* — James E. Howard; Andre Pallapies

(57) ABSTRACT

A dishwasher includes a washing chamber defining a washing volume in which items to be washed are disposed and a storage container disposed in the washing chamber for retaining items at a predetermined storage location within the washing volume. A spray device is provided that is operable to spray at least one jet of liquid and a dissolving chamber having a chamber floor with at least one aperture is mounted to the storage container. The storage container and the spray device are mounted relative to one another such that the dissolving chamber is wetted with liquid that has been sprayed by the spray device.

25 Claims, 4 Drawing Sheets

(56) References Cited

U.S. PATENT DOCUMENTS

Figure 1:
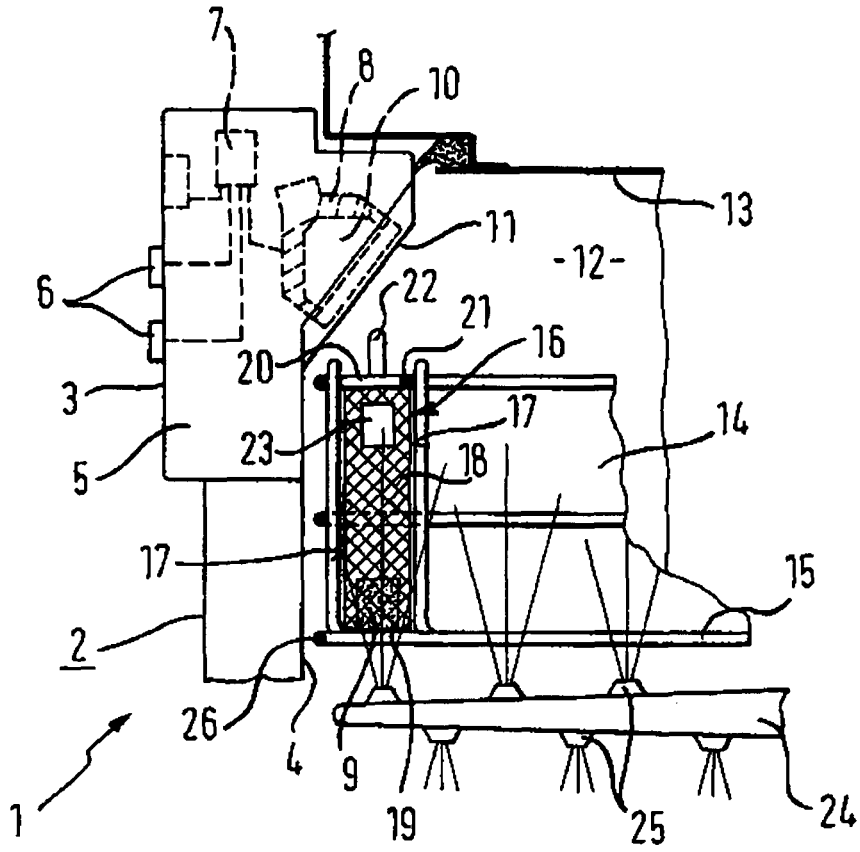

| | | | | | |
|---|---|---|---|---|---|
| 2,692,165 | A | * | 10/1954 | Sinkwich | 422/112 |
| 2,734,520 | A | * | 2/1956 | Abresch et al. | 134/174 |
| 2,808,063 | A | * | 10/1957 | Abresch et al. | 134/57 D |
| 2,935,207 | A | * | 5/1960 | Miller | 211/74 |
| 2,969,072 | A | * | 1/1961 | Barritt | 134/93 |
| 3,029,827 | A | * | 4/1962 | Mixon | 134/93 |
| 3,612,074 | A | * | 10/1971 | Dossey | 134/93 |
| 3,850,344 | A | * | 11/1974 | Burge et al. | 222/67 |
| 3,960,290 | A | * | 6/1976 | Yake et al. | 220/835 |
| 4,735,228 | A | | 4/1988 | Boedecker et al. | |
| 4,913,832 | A | * | 4/1990 | Kruse et al. | 510/224 |
| 5,287,984 | A | * | 2/1994 | Michael | 220/812 |
| 5,967,158 | A | * | 10/1999 | Smith et al. | 134/25.2 |
| 2002/0185162 | A1 | * | 12/2002 | Rosenbauer et al. | 134/57 D |
| 2003/0213505 | A1 | * | 11/2003 | Price et al. | 134/25.2 |
| 2004/0106534 | A1 | * | 6/2004 | Nitsch et al. | 510/220 |
| 2004/0194810 | A1 | * | 10/2004 | Strothoff et al. | 134/25.2 |
| 2005/0045672 | A1 | * | 3/2005 | Marone | 222/637 |

FOREIGN PATENT DOCUMENTS

| | | | | |
|---|---|---|---|---|
| DE | 4429774 | C1 | | 11/1995 |
| DE | 198 36 857 | | * | 2/2000 |
| DE | 199 35 728 | | | 2/2001 |
| DE | 10260162 | A1 | | 7/2004 |
| DE | 202004006632 | U1 | | 10/2004 |
| EP | 0 298 353 | | | 1/1989 |
| EP | 0488093 | A1 | | 6/1992 |
| EP | 0 678 275 | | | 10/1995 |
| EP | 0691102 | A1 | | 1/1996 |
| EP | 0 882 423 | | | 12/1998 |
| EP | 1 002 494 | | | 5/2000 |
| EP | 1 319 360 | | | 6/2003 |
| FR | 2 342 622 | | * | 10/1997 |
| GB | 2 198 932 | | * | 6/1988 |
| JP | 02-302240 | | * | 12/1990 |
| JP | 03-133419 | | * | 6/1991 |
| JP | 6017663 | U | | 3/1994 |
| JP | 09-173271 | | * | 7/1997 |
| JP | 2000-225087 | | * | 8/2000 |
| JP | 2000-287904 | | * | 10/2000 |
| JP | 2001-204675 | | * | 7/2001 |
| JP | 2001-286428 | | * | 10/2001 |
| JP | 2003010093 | A | | 1/2003 |
| WO | 03096863 | A2 | | 11/2003 |
| WO | WO 2004/084699 | | | 10/2004 |

OTHER PUBLICATIONS

European Patent Office 0 298 353 Jan. 1989.*
European Patent Office 0 850 590 Jul. 1998.*
International Search Report PCT/EP2005/055465.
Report of Examination JP 2007-548784.

* cited by examiner

DISHWASHER WITH A DISSOLVING CHAMBER

The invention relates to a dishwasher having a spray device and having a dissolving chamber which has a chamber floor with at least one aperture and which serves for introducing a detergent and is disposed in a storage container for items that are to be washed.

DE 3722648 A1 discloses a device for receiving dish washing machine detergents in pressed powder form in domestic dish washing machines which allows the pressed-powder detergent to be received in the interior of the dish washing machine without adversely affecting the washing results. This is achieved in that the device is embodied as a dispensing container which can be mounted in the interior of the dish washing machine and has at least one dispensing chamber accommodating the pressed-powder detergent with sides and/or bottom surfaces which are perforated at least in parts.

It is, however, disadvantageous that no particular location is assigned to the dispensing container and it happens that the spray jets emerging from a spray device only inadequately wet the pressed-powder pellets or do not strike them at all. As a consequence insufficient fluid penetrates into the dispensing container. This has a negative effect on the dissolvability of the pressed-powder pellets, with the result that they do not completely dissolve. This leads to a poor washing result, so the items requiring to be washed are not clean after the washing operation has been completed.

It is also known from the prior art that the detergent tablets are placed into a crockery basket before the washing operation and then dissolve over the course of the entire washing operation.

A serious disadvantage is caused by the fact that the detergent tablet dissolves only inadequately during the washing operation and undesirable lumps remain in the washing chamber after the cleaning operation. It also cannot be ruled out that the detergent tablet comes into contact with the dishes and as a result undesirable blemishes can form on the dishes.

The object underlying the invention is to embody the chamber floor of the dissolving chamber in water-conducting domestic appliances of the type described in more detail in the introduction in such a way that after the washing operation the dissolving chamber is free of detergent and the items requiring to be washed are free from blemishes and clean after the operation.

This object is achieved according to the invention in that the dissolving chamber is integrated in an area that is wetted by a jet of liquid within the storage container.

This solution is characterized in particular in that after the washing operation no detergent residues are contained in the water-conducting domestic appliance and it is thus ensured that the detergent has fully dissolved. It is also ensured by means of this arrangement that the detergent is wetted by the jet of liquid, rinsed out and fully dissolves. By means of this arrangement the detergent is furthermore prevented from coming into contact with the items to be washed and consequently the formation of blemishes on the items requiring to be washed is prevented.

According to a preferred embodiment it is provided that the jet of liquid strikes the chamber floor at right angles.

This ensures that the jet of liquid sprays the detergent with liquid. At the same time the jet of liquid is prevented from being deflected off the floor of the dissolving chamber onto the side walls of the washing chamber, since this can lead to undesirable noise being generated for the user.

According to a further preferred embodiment of the subject matter of the invention it can be provided that the dissolving chamber is positioned on a front side wall, of the storage container.

By means of this arrangement it is ensured that the dissolving chamber is easily accessible for the user. Furthermore the mechanical design overhead involved is very small since no additional tools are required.

In an alternative embodiment of the subject matter of the invention it can be provided that the dissolving chamber is disposed on a front wall of the storage container.

The essential advantage in this case is that the dissolving chamber is positioned so as to be easily accessible for the user for the purpose of cleaning as a result of food residues having accumulated for example.

In a further alternative embodiment of the subject matter of the invention it can be provided that the dissolving chamber is disposed in the middle of the storage container.

The solution reveals the advantage that the dissolving chamber can effectively be sprayed with liquid by the spray device and as a result the detergent can dissolve particularly well. In addition the dissolving chamber is easily accessible for the user.

According to a further preferred embodiment of the subject matter of the invention it is provided that the spray device is embodied as a rotating spray arm having at least one spray nozzle.

The solution reveals the advantage that the dissolving chamber and the detergent disposed in the dissolving chamber are supplied with sufficient liquid.

According to an alternative embodiment of the subject matter of the invention it is provided that the spray device is embodied as a spray base and at least one outlet of a spray pipe is disposed under the dissolving chamber.

What is successfully achieved by means of this arrangement is that, irrespective of the location of the dissolving chamber, the detergent can be supplied with water within the dissolving chamber in order thereby to dissolve said detergent.

According to a further alternative embodiment of the subject matter of the invention it is provided that the spray device is embodied as a spray nozzle or sprinkler head. The solution is characterized in particular in that it can be implemented at reasonable cost. Furthermore, by means of this arrangement the detergent is sufficiently wetted so that it can dissolve.

According to a preferred embodiment it is provided that the chamber floor of the dissolving chamber has slit-shaped apertures.

This solution offers the advantage that the manufacturing overhead is very small. Furthermore the jet of liquid emerging from a spray device can penetrate through the slit-shaped apertures and dissolve the detergent.

According to a further advantageous embodiment of the subject matter of the invention it is provided that the slit-shaped apertures of the chamber floor are disposed longitudinally and/or transversely.

The advantage is that the detergent is essentially dissolved during operation. The detergent is solubilized through the apertures, as a result of which the active agents in the detergent can dissolve more efficiently in the washing liquor during the subsequent washing cycle.

According to a further advantageous embodiment of the subject matter of the invention it is provided that the chamber floor is embodied in an inward-facing arched shape.

The detergent, more particularly detergent in powder form, is thereby advantageously deposited on the side walls, as a result of which the detergent in powder form dissolves more slowly and is consequently entrained into the subsequent phases of the washing operation. By this means it is ensured that the items requiring cleaning are also cleaned at a later time.

According to a further advantageous development of the invention it is provided that the dissolving chamber can be closed by means of a lid.

By means of this measure the detergent is prevented from falling out of the dissolving chamber independently and no detergent residues will remain in the washing chamber after operation.

According to a next preferred embodiment it is provided that the dissolving chamber has a filler opening for the detergent on at least one side wall and/or on the lid.

The solution reveals the advantage that the detergent is supplied to the dissolving chamber by the user in a very user-friendly manner. This solution can also be implemented at very reasonable cost.

According to a further embodiment of the subject matter of the invention it can be provided that at least the lid and at least one side wall of the dissolving chamber are permeable to liquid.

By means of this measure it is successfully ensured that cleaning liquid enters the dissolving chamber in order to dissolve the detergent. This equally prevents the cleaning liquid from accumulating in the container, filling the latter and thereby washing the detergent out of the dissolving chamber.

Figure 2:
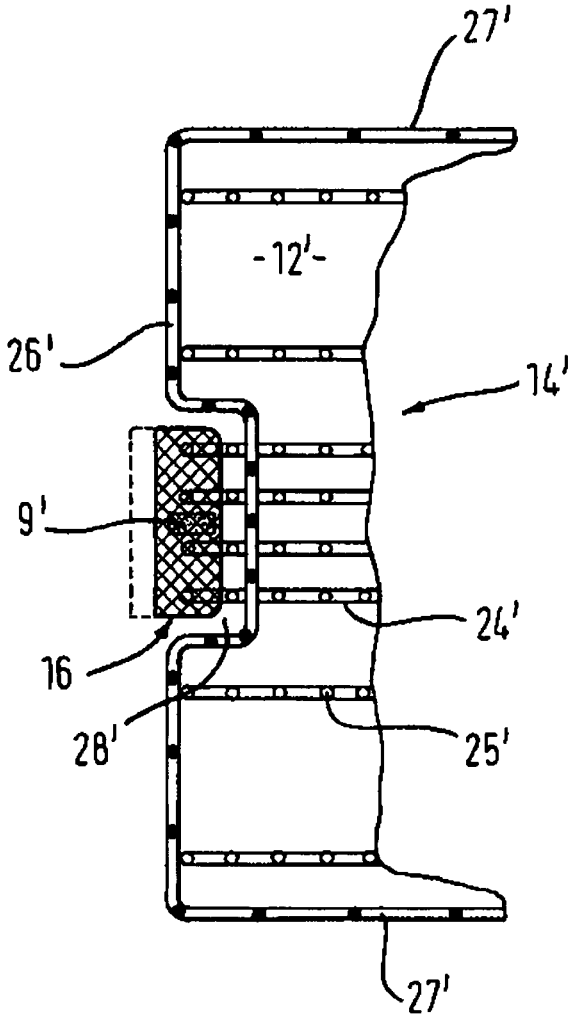
Figure 3:
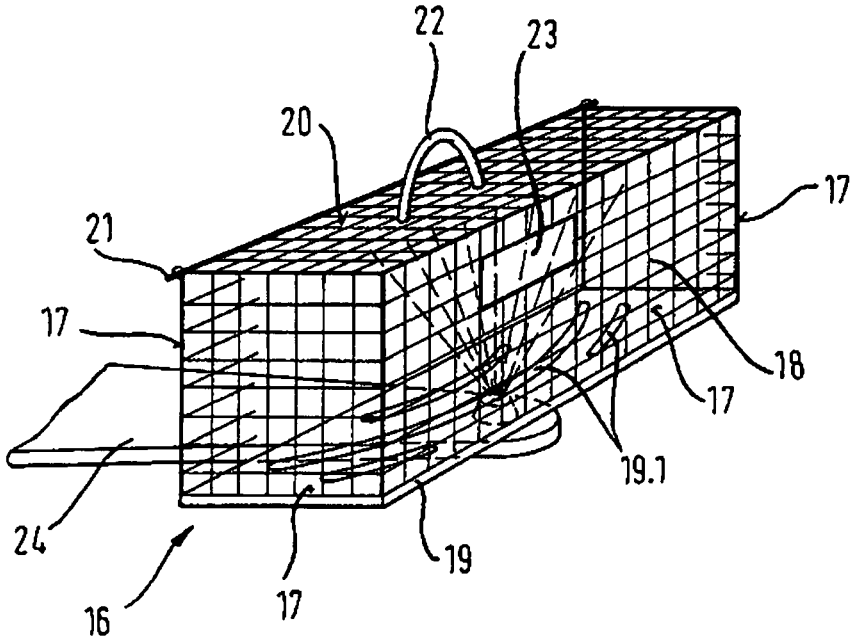
Figure 4:
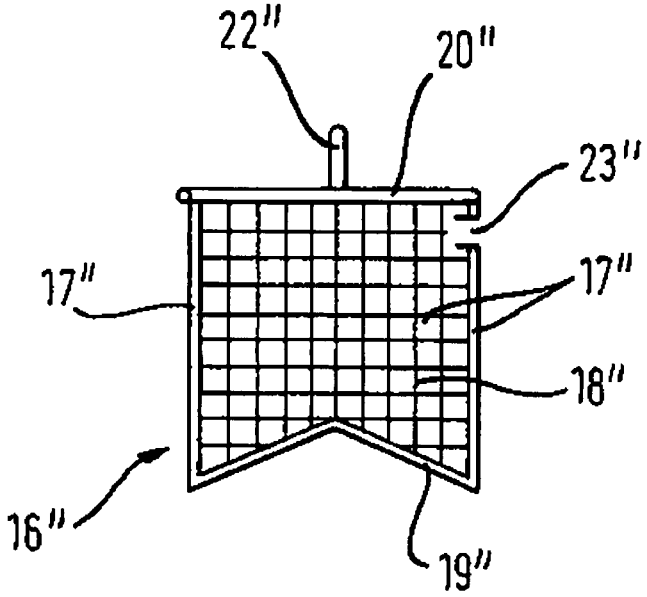

The invention is explained in a following description with reference to an exemplary embodiment depicted in simplified form in the drawing, in which:

FIG. 1 shows a side view of a dishwasher having a dissolving chamber in a crockery basket in a sectional and partially cut representation, FIG. 2 shows a top view of a crockery basket of the dishwasher having a dissolving chamber disposed on its front in a sectional representation, FIG. 3 shows the dissolving chamber in a perspective view from above, and FIG. 4 shows a dissolving chamber having an arched chamber floor in a front view.

FIG. 1 shows a first embodiment of an inventive dishwasher 1 having a door 2 which comprises an outer door 3 and an inner door 4. Arranged on a door panel 5 are program selection buttons 6 which are connected to an electrical control and regulating electronics module 7 installed inside the door 2. Various programs for executing a washing operation are stored in the memory in the control and regulating electronics module 7. Located within the door 2 are a detergent dispenser 8 which is connected to the control and regulating electronics module 7 and serves for storing a block-shaped detergent 9 and a rinsing agent (not shown). However, the detergent dispenser 8 is also suitable for storing a liquid detergent or detergent in powder form. A chamber 10, to which a filler flap 11 is assigned for closing same, serves for storing the detergent 9 and is disposed set back in the inner door 4. A washing chamber 12 which is accessible via the opened door 2 and whose inner lining 13 is shaped from stainless steel has on its container side walls (not shown) two guide rails (not shown) on which a crockery basket embodied as a storage container 14 for storing items to be washed (not shown) is held. The body of the storage container 14 has plastic-coated metal rods 15. A dissolving chamber 16 which is integrated into the body of the storage container 14 comprises side walls 17 which have a grid 18 and a chamber floor 19 which has slit-shaped apertures not shown in FIG. 1. The dissolving chamber 16 can be opened by means of a lid 20 having a fine-mesh grid, which lid 20 is swivel-mounted about a horizontal axis 21 disposed on the dissolving chamber 16. A handle 22 is arranged on the lid 20. Alternatively the lid 20 can also be embodied as a sliding lid. A filler opening 23 is arranged on the side wall 17 so that detergent can be supplied to the dissolving chamber 16.

A spray arm embodied as a spray device 24 has a plurality of spray nozzles 25 on its top and bottom sides. In the case of spray devices 24, more particularly in the case of a rotating spray arm, the dissolving chamber 16 is advantageously disposed on a front wall 26 in the middle of the storage container 14.

FIG. 2 shows a storage container 14' having the dissolving chamber 16 from FIG. 1. A spray device 24' embodied as a spray base and having spray nozzles 25' is integrated into the body of the storage container 14'. Alternatively the spray base can also be located under the storage container 14'. The storage container is assigned a front wall 26' and side walls 27'. The dissolving chamber 16 is removably held on the front wall 26' in the middle of the storage container at a location predefined therefor. For this purpose the storage container 14' has a recess 28' for inserting the dissolving chamber 16 in order to be able to arrange the dissolving chamber 16 in the correct position relative to the storage container 14'. Alternatively, however, the dissolving chamber 16 can also be disposed on the side walls 27' of the storage container 14', albeit also in such a way that the mounting location of the dissolving chamber 16 is predefined by positioning measures on the storage container 14'.

FIG. 3 shows a more detailed view of the dissolving chamber 16 which is disposed above the spray device 21. As already mentioned, it has four chamber walls 17 which are embodied as a fine-mesh grid 18. Alternatively, the chamber walls 17 can optionally also be embodied as a coarse-mesh grid. The chamber floor 19 of the dissolving chamber 16 has slit-shaped apertures 19.1. The slit-shaped apertures 19.1 are embodied longitudinally with respect to the direction of the emerging jet of liquid. Alternatively, the slit-shaped apertures 19.1 can also be embodied transversely with respect to the direction of the emerging jet of liquid.

FIG. 4 shows a dissolving chamber 16" according to a second embodiment having a rectangular outline. It has four chamber walls 17" which are embodied from a fine-mesh grid 18". Alternatively, one or more small openings can be arranged instead of the fine-mesh grid 18". Equally, a coarse-mesh grid can also be used as an alternative in order to dissolve the detergent more quickly. A chamber floor 19" has slit-shaped apertures (not shown). The chamber floor 19" of the dissolving chamber is arched along the longer rectangular sides toward the inside of the chamber so that the detergent, more particularly detergent in powder form, slides down to the interface between the chamber walls 17" and the arched chamber floor 19". There, it is deposited progressively, forms small heaps and so cannot be immediately washed out of the dissolving chamber 16". This enables the detergent to be more evenly distributed during the washing operation. Alternatively, the arch of the chamber floor 19" can also be embodied transversely with respect to the longer rectangular side. A filler opening 23" is also disposed on the side wall 17" in order to supply detergent to the dissolving chamber. Provided opposite the chamber floor 19" on the outside of a chamber roof is a handle 22" serving for handling the dissolving chamber 16", which handle 22" in the present exemplary embodiment runs along the chamber floor arch.

The detergent 9, more particularly a detergent tablet, is supplied to the dissolving chamber 16 by the user. The user closes the washing chamber 12 by means of the door 2 and with the aid of the program selection switch 6 selects a program which essentially comprises the program steps "prewash—clean—intermediate rinse—final rinse—dry" and is stored in the control and regulating electronics module 7.

Because the chamber walls 17 have a fine-mesh grid 18 and the chamber floor 19 has slit-shaped apertures 19.1, no relatively large detergent elements fall out of the dissolving chamber 16 into the washing chamber 12 and onto the items to be washed, since the detergent 9 is prevented from being flushed out in large segments. Furthermore, the fine-mesh grid 18 is embodied to be permeable to water so that the liquid can penetrate into the dissolving chamber 16 and dissolve the detergent 8.

It is also ensured by means of the arching of the chamber floor 19" shown in FIG. 4 that the detergent in powder form accumulates on the side walls. This prevents the detergent in powder form from already being flushed out of the dissolving chamber 16 during an early phase of the washing operation.

The invention claimed is:

1. A dishwasher comprising:

a washing chamber defining a washing volume in which items to be washed are to be disposed;

a storage container disposed in the washing chamber for retaining items at a predetermined storage location within the washing volume;

a spray device operable to spray at least one jet of liquid; and a dissolving chamber having a chamber floor with at least one aperture, the dissolving chamber being mounted to the storage container and the storage container and the spray device being mounted relative to one another such that the dissolving chamber is wetted with liquid that has been sprayed by the spray device, wherein the aperture is shaped so that the jet follows the aperture along a portion of a movement path of the spray device, the aperture being a slot shape with a length longer than a width and the portion corresponding to the length.

2. The dishwasher as claimed in claim 1, wherein the spray device is a rotating spray arm having at least one spray nozzle.

3. The dishwasher as claimed in claim 1, wherein the aperture is shaped to correspond to, and is vertically aligned with, a nozzle that forms the at least one jet of liquid along the portion of the movement path.

4. The dishwasher as claimed in claim 1, wherein the movement path is arcuate.

5. The dishwasher as claimed in claim 1, wherein the storage container comprises a plurality of openings adapted to allow the jet of liquid to contact the items to be washed and a smallest opening of the plurality of openings is larger than the at least one aperture.

6. The dishwasher as claimed in claim 1, wherein the dissolving chamber is adapted to prevent contact between the items to be washed and detergent in the dissolving chamber.

7. The dishwasher as claimed in claim 1, wherein the slot is arcuate and the length is arcuate.

8. A dishwasher comprising:

a washing chamber defining a washing volume in which items to be washed are disposed;

a storage container disposed in the washing chamber for retaining the items to be washed at a predetermined storage location within the washing volume;

a spray device operable to spray at least one jet of liquid; and a dissolving chamber adapted to prevent contact between the items to be washed and detergent in the dissolving chamber, the dissolving chamber having a chamber floor with at least one aperture configured to permit direct entry of at least a portion of the at least one jet of liquid, the dissolving chamber being mounted to the storage container and the storage container and the spray device being mounted relative to one another such that the dissolving chamber is wetted with liquid that has been sprayed by the spray device, wherein a nozzle that generates the at least one jet of liquid is vertically aligned with the at least one aperture in at least one position of the spray device.

9. The dishwasher as claimed in claim 8, wherein the jet of liquid strikes the chamber floor at right angles.

10. The dishwasher as claimed in claim 8, wherein the dissolving chamber is disposed on a front side wall of the storage container.

11. The dishwasher as claimed in claim 8, wherein the dissolving chamber is disposed on a front wall of the storage container.

12. The dishwasher as claimed in claim 8, wherein the dissolving chamber is disposed in the middle of the storage container.

13. The dishwasher as claimed in claim 8, wherein the spray device includes a spray base and at least one spray pipe communicated with the spray base and at least one outlet of the at least one spray pipe is disposed under the dissolving chamber.

14. The dishwasher as claimed in claim 8, wherein the spray device is a selected one of a spray nozzle and a sprinkler head.

15. The dishwasher as claimed in claim 8, wherein the chamber floor of the dissolving chamber has slit-shaped apertures.

16. The dishwasher as claimed in claim 15, wherein the slit-shaped apertures of the chamber floor are arranged one of longitudinally and transversely.

17. The dishwasher as claimed in claim 8, wherein the chamber floor is embodied in an inward-facing arched shape.

18. The dishwasher as claimed in claim 8, wherein the dissolving chamber can be closed by means of a lid.

19. The dishwasher as claimed in claim 18, wherein the dissolving chamber has a filler opening for the detergent on a selected one of at least one side wall and on the lid.

20. The dishwasher as claimed in claim 18, wherein at least the lid and at least one side wall of the dissolving chamber are permeable to liquid.

21. The dishwasher as claimed in claim 8, wherein a nozzle that generates the at least one jet of liquid is vertically aligned with the at least one aperture along a range of movement of the spray device.

22. The dishwasher as claimed in claim 21, wherein the movement path is arcuate.

23. The dishwasher as claimed in claim 8, wherein the storage container comprises a plurality of openings adapted to allow the jet of liquid to contact the items to be washed and a smallest opening of the plurality of openings is larger than the at least one aperture.

24. The dishwasher as claimed in claim 8, wherein the aperture is shaped to correspond to a portion of a movement path of the spray device.

25. The dishwasher as claimed in claim 8, wherein the storage container and the spray device are mounted relative to one another such that the liquid that wets the dissolving chamber is prevented from being deflected off the floor of the dissolving chamber onto a side wall of the washing chamber.

* * * * *